US007997589B2

(12) United States Patent
Park

(10) Patent No.: US 7,997,589 B2
(45) Date of Patent: Aug. 16, 2011

(54) SKATING SHOES

(76) Inventor: Gyeonghui Park, Seoul (KR)

( * ) Notice: Subject to any disclaimer, the term of this patent is extended or adjusted under 35 U.S.C. 154(b) by 378 days.

(21) Appl. No.: 12/162,794

(22) PCT Filed: Feb. 20, 2007

(86) PCT No.: PCT/KR2007/000875

§ 371 (c)(1),
(2), (4) Date: Oct. 21, 2008

(87) PCT Pub. No.: WO2007/094649

PCT Pub. Date: Aug. 23, 2007

(65) Prior Publication Data

US 2009/0160142 A1 Jun. 25, 2009

(30) Foreign Application Priority Data

Feb. 17, 2006 (KR) ..... 10-2006-0016552

(51) Int. Cl.
*A63C 17/00* (2006.01)

(52) U.S. Cl. ..... 280/11.19; 280/11.27

(58) Field of Classification Search ..... 280/7.13, 280/11.231, 11.223, 11.208, 11.19, 11.17, 280/11.27, 11.24, 11.221, 841
See application file for complete search history.

(56) References Cited

U.S. PATENT DOCUMENTS

| | | | | |
|---|---|---|---|---|
| 3,983,647 | A * | 10/1976 | Stubbmann | 40/430 |
| 4,928,982 | A | 5/1990 | Logan | |
| 5,398,970 | A * | 3/1995 | Tucky | 280/841 |
| 6,120,039 | A * | 9/2000 | Clementi | 280/11.19 |
| 6,247,708 | B1 * | 6/2001 | Hsu | 280/11.223 |
| 6,450,508 | B1 * | 9/2002 | Chu | 280/11.208 |
| 6,450,509 | B2 | 9/2002 | Adams | |
| 6,523,836 | B1 * | 2/2003 | Chang et al. | 280/11.223 |
| 6,913,270 | B2 * | 7/2005 | Wang | 280/11.24 |
| 6,926,289 | B2 * | 8/2005 | Wang | 280/7.13 |
| 7,232,131 | B2 * | 6/2007 | Hurst | 280/11.27 |
| 7,610,972 | B2 * | 11/2009 | Adams et al. | 280/11.231 |
| 2003/0001347 | A1 * | 1/2003 | Chen et al. | 280/11.221 |

FOREIGN PATENT DOCUMENTS

| | | | |
|---|---|---|---|
| JP | S50-139077U | A | 11/1975 |
| JP | S53-089878U | A | 7/1978 |
| KR | 10-0518113 | B1 | 6/2005 |

OTHER PUBLICATIONS

International Search Report (ISR) dated Jun. 14, 2007, for International Application PCT/KR2007/000875.
EPO Search Report for European Patent Application No. 07709024.9 which corresponds to U.S. Appl. No. 12/162,794.

* cited by examiner

*Primary Examiner* — Hau V Phan
(74) *Attorney, Agent, or Firm* — LRK Patent Law Firm

(57) ABSTRACT

The present invention relates to skating shoes that are capable of walking and skating, and more particularly, to skating shoes that are possible of self-driving skating and free conversion between walking and skating without a particular operation.

17 Claims, 6 Drawing Sheets

SKATING SHOES

CROSS-REFERENCES TO RELATED APPLICATIONS

This is a US national stage of International Application PCT/KR2007/000875, filed Feb. 20, 2007, and claims the benefit of priority of Republic of Korea patent application number 10-2006-0016552, filed Feb. 17, 2006, both of which are incorporated by reference herein in their entireties.

INTRODUCTION

The present invention relates to skating shoes and inline skates, and more particularly, to skating shoes that can provide direct alternation between walking and skating without a particular mechanical or functional converting unit classified in the international patent classification, IPC A63C 17/20.

BACKGROUND

In conventional skating shoes described in the U.S. Pat. No. 6,450,509, a roller is mounted on a rear lower part of the shoe. In walking mode, the shoe is horizontally arranged so that a friction member at a front lower part of the shoe and the roller endure the user's weight together. In skating mode, the shoe is backwardly slanted so that only the roller endures the user's weight.

The Korea Patent No. 10-0518113 (entitled "wheel-mounted type shoes") is to solve the problem of rolling in walking mode, which is described in the U.S. Pat. No. 6,450,509. Referring to FIG. 12A, a roller is mounted on an upper part than a bottom part of an outsole of the shoe so that the roller does not contact to the ground in walking mode. In this structure, the roller 2 should be mounted on an outer edge of the outsole 1 of the shoe where the user's ankle is bent relatively more than an inner edge.

In other words, in walking mode, all of the outer and inner edges of the outsole and a part between the two edges are contacted to the ground in walking pose with the shoes being horizontally arranged. In skating mode, the shoe is slanted outwardly so that the roller is contacted to the ground in the pose of "O" character type legs.

On the other hand, there are skating methods as follows:

A pushing method is a method that generates self driving force by direct angular movement to the ground while the roller moves in horizontal direction when a user stretches his legs in horizontal direction at the time of acceleration. Particularly, in the inline skate, pushing is skating itself.

A gliding method is a skating method that a user proceeds forward by gravity like as down-hill of a snow board or inertia. However, this method is not constant and impractical because it cannot generate self driving force in case of flat or uphill road.

The pushing conditions are as follows:

Straight nature: a roller should be arranged so that a sufficient distance between the roller axis is obtained in a column (aligning shoes in front and rear direction), thereby allowing a driving course to be fixed so that driving force is not dissipated while pushing.

Inward slant (slanting a shoe inwardly): the outer edge of the lower part of the shoe is raised upward and the inner edge is slanted so as to contact to the ground while right and left legs of the user reciprocate in horizontal direction. In this time, a structure, where the roller can well contact to the ground, is required.

Height: stable one foot standing should be possible with a leg for enduring the user's weight when the user folds his leg used for pushing after pushing so that the lower part of the shoe does not contact to the ground by unevenness (concave and convex) of the ground at the time of skating or pushing. In this time, because it may be very dangerous if the user drops down when the user loses his/her balance and the lower part of the shoe is contacted to the ground, a structure that ensures sufficient height is required.

Roller specification: large diameter is required so as to transfer pushing force to the ground effectively without stumbling of the roller by the unevenness. Wide width is required so that the user can easily keep his balance at the time of one foot standing.

Conventional skating shoes are analyzed below based on the conditions for enabling the pushing method.

In U.S. Pat. No. 6,450,509, a roller is provided only on a rear part of a shoe and accordingly, it is difficult to fix direction and thus, the shoe does not have the straight nature. The user's body should be bent forwardly so as to stand to acceleration, but on the contrary, the weight is loaded on the rear part and one foot standing is particularly difficult.

In Korea Patent No. 10-0518113, if the user tries pushing, the inner edge of the outsole contacts to the ground and the roller at the outer edge is raised upwardly so that the pushing action itself is impossible.

Further, because the roller is provided on the upper part of the outsole, it is difficult to prevent the outsole for one foot standing from contacting to the ground. Particularly, as shown in FIG. 12B, the outsole near the roller 2 probably stumbles on the unevenness 6 so that the user drops down. In addition, it is difficult for the user to skate or push normally because the above structure should use a roller of relatively small diameter and narrow width. Accordingly, the user can do the gliding restrictively only when the road is sloppy, and it may become more dangerous regardless of solution of the rolling phenomenon.

SUMMARY

Accordingly, an object of the present invention is to provide skating shoes on which a user can directly provide the alternation between walking and skating without a converting unit and can do stable self-driving pushing by pushing the ground with a skating unit or a roller while reciprocating both legs in horizontal direction like an inline skate.

Another object of the present invention is to provide skating shoes on which a user can maintain a stable pose without danger of backward drop in comparison with the structure of U.S. Pat. No. 6,450,509. The shoe has a roller specification of larger diameter and wider width in comparison with the structure of Korea Patent No. 10-0518113, thereby allowing easy skating. Particularly, in skating mode, the shoe has less provability of contacting to the unevenness of the ground, thereby allowing safe skating.

According to one aspect of the present invention, there are provided skating shoes, which comprise: left and right shoes on which a user wears, wherein a lower part of each shoe comprises: a friction member for providing breaking force by being contacted to the ground; and a plurality of rollers for providing rolling movement by being contacted to the ground; wherein the friction member is arranged in longitudinal direction at an outer edge of the lower part and projected downwardly; the roller is arranged in longitudinal direction at an inner edge of the lower part and projected downwardly; a predetermined space is formed between the friction member and the roller so that the friction member can be sufficiently risen when the shoe is slanted while skating; and a space portion is formed upwardly between the friction member and the roller so as to prevent the lower part from contacting to the ground.

According to the structure as described above, when the user walks and the shoe is horizontally arranged, the friction member is contacted to the ground at the outer edge of the shoe's lower part and the roller is contacted to the ground at the inner edge of the shoe's lower part so as to endure the user's weight together. In this time, the space portion is not contacted to the ground.

At the time of pushing when the shoe is slanted inwardly, only the roller is continuously contacted to the ground but the friction member is not contacted to the ground. The roller of one shoe proceeds in a constant course and the roller of the other shoe proceeds in transverse direction to the course so as to provide driving force caused by angular movement, thereby allowing driving force by pushing method of an inline skate to be provided.

Here, when the user stretches his leg in transverse direction for pushing, the friction member mounted on the outer edge is naturally risen up and the roller mounted on the inner edge performs the pushing while naturally contacting to the ground.

Afterwards, because the user's balance is unstable in skating modes particularly at the time of one foot standing, any part of the shoe except the roller may contact to the ground, resulting in fatal danger. When the shoe is slanted about the roller as an axis, the friction member is most far away so as to be sufficiently risen, but part near the roller cannot be sufficiently risen. It is inevitable to provide a sufficient space between the friction member and the roller upwardly.

The roller is preferably a drum type roller of wide width so that the user can easily keep his balance at the time of one foot standing. In this time, because the user performs skating by slanting the shoe, the bottom part of the roller preferably has a reverse camber so as to be protruded toward the user.

As a result, in walking mode, a corner of the bottom part opposite to the protruded part is contacted to the ground and, in skating mode, the shoe is slanted inwardly so as to bring the corner of the protruded bottom part into contact with the ground while being contacted to the ground.

As described above, the skating shoes according to the present invention produces the following effects.

First, the user can easily and immediately adapt to frequent changes of environment of walking and skating. Simultaneously, the user can perform self-driving skating by pushing the ground directly with the roller without depending on gravity of downhill or inertia of walking. Accordingly, the user can play inline skating without an additional inline skate.

Second, the user can take skating pose more easy and stable than the shoes of U.S. Pat. No. 6,450,509 in which the user's weight is loaded on the rear part. In comparison with Korea Patent No. 10-0518113, because the shoe has less provability of contacting to the unevenness of the ground, it is safe. Further, because the shoe can include a roller of relatively large specification, the user can easily skate.

BRIEF DESCRIPTION OF THE DRAWINGS

The above and other objects, features and advantages of the present invention will be more apparent from the following detailed description taken in conjunction with the accompanying drawing, in which:

FIG. 4A shows the shoe including two rollers at front and rear parts, and FIG. 4B shows the shoe including two rollers at the front part and one roller at the rear part, and FIG. 4C shows the shoe including four rollers;

FIG. 6A shows the shoe including a roller born by an outsole, and FIG. 6B shows the shoe including an outsole formed only on an outer edge of the shoe, and FIG. 6C shows the shoe including two parallel type rollers instead of a drum type roller;

FIG. 7A shows the roller fixed to a ceiling of the roller receiving unit and FIG. 7B shows the roller tightly inserted into the roller receiving unit;

FIG. 9A shows the lower part including the bracket fixed to the ceiling of the roller receiving unit by a fixing element, and FIG. 9B shows the lower part including the bracket tightly inserted into a space, and FIG. 9C shows the lower part to be mounted with the extended part in case of using the extended part;

FIG. 10A shows the roller not including a reverse camber, and FIG. 10B shows the roller including a reverse camber;

FIG. 12A shows a walking pose, and FIG. 12B shows a skating pose.

DETAILED DESCRIPTION

One exemplary embodiment according to the present invention will be explained below.

Figure 1:
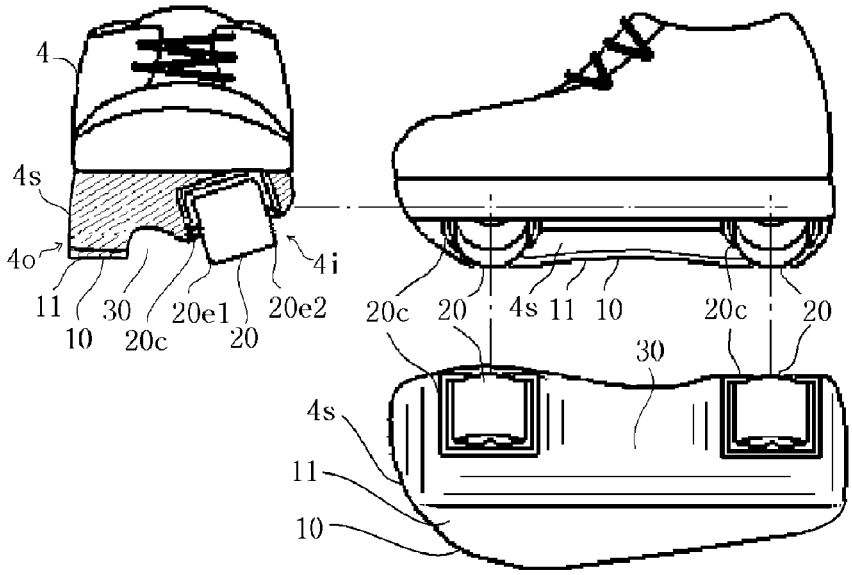
FIGS. 1A to 1C are respectively front, side and bottom views illustrating a skating shoe according to one embodiment of the present invention.

Referring to FIG. 1, a friction member 10 may be formed in a lower part of a shoe 4 by projecting downwardly a bottom part 11 of an outer edge 4*o* of an outsole 4*s*, or may be formed by combining a wear-resistant member with the bottom part 11 and projecting it downwardly.

The shoe includes at least two rollers and the rollers are configured to be downwardly projected from a roller receiving unit 20*c* formed in the inside 4*i* of the outsole and be rollably.

Accordingly, a space portion 30 is formed between the bottom part 11 of the outer edge of the outsole and the roller 20 while a predetermined space is maintained between them.

Further, a drum type roller as wide as possible may be used as the roller so that a user can easily keep his balance while skating. The roller receiving unit 20*c* may be formed to be slanted so that the bottom part of the roller is protruded toward the user's body so as to form a reverse camber. Or, the roller may be mounted on a slant portion of the extended part so as to be rollably while slanting a bearing of a rotating axis of the roller 20.

Figure 3:
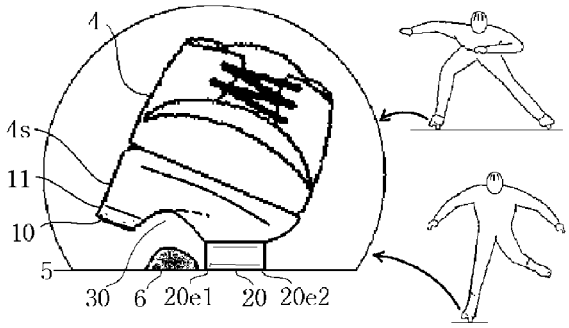
FIG. 3 is a front view illustrating the skating shoe.

According to the construction as described above, while the user is walking, only a corner 20*e*1 opposite to a corner 20*e*2 of the roller protruded toward the user is contacted to the ground. Referring to FIG. 3, while the user is skating, the entire bottom part of the roller is contacted to the ground 5 and accordingly, the user can keep stable balance. Further, the user can safely skate because he can effectively pass over unevenness 6 on the ground due to the space portion 30.

Because generally a rear part 4*r* of the lower part of the shoe is relatively narrow, width of the roller at the rear part is preferably not same as the roller at a front part 4*f* in the present invention in which the space portion 30 is very important.

Figure 4:
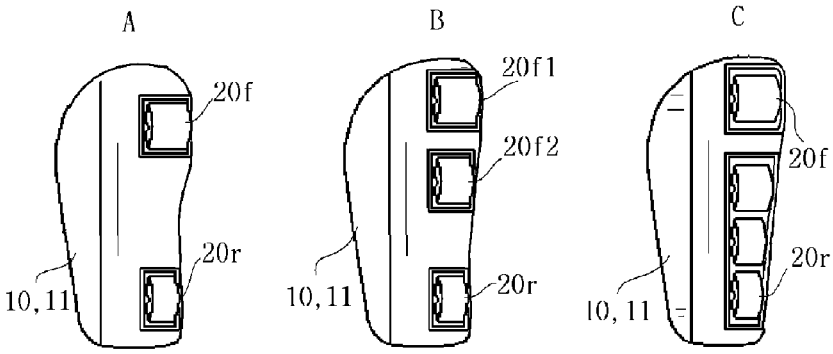
FIGS. 4A to 4C are bottom views of the shoe, where

Accordingly, referring to FIG. 4, there are illustrated shoes in which the roller 20 at the front part 4*f* of the lower part is wider than the roller 20 at the rear part 4*r*.

Figure 2:
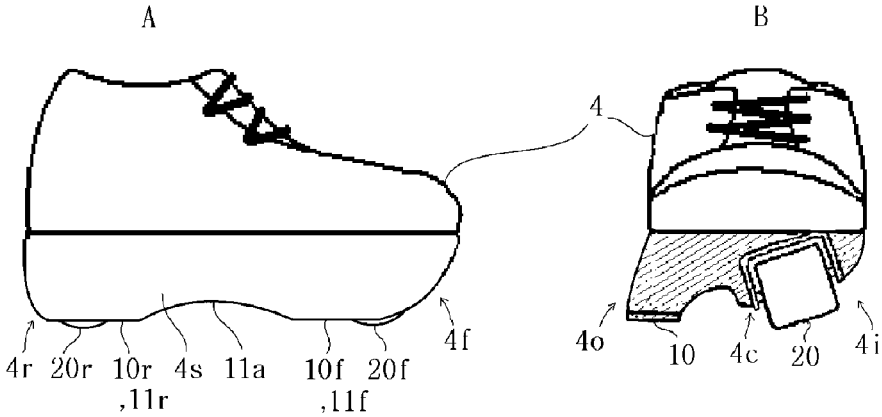
FIGS. 2A and 2B are respectively side and front views illustrating a friction member 10 (10*r*, 10*f*) of the shoe.

In the case that the rollers are same in width, the friction member 10 at the outer edge 4*o* of the lower part in FIG. 2, that is, the bottom part 11 of the outsole is protruded more outwardly so as to arrange the roller 20 more nearly toward a central part 4*c* of the lower part. If the roller is arranged at the central part 4*c*, the slant of the shoe can be maintained more easily in case of rollers of same width.

Referring to FIG. 2, at the front and rear parts 4*f* and 4*r* of the lower part, the friction member 10 is arranged more backward than forefront and rearmost rollers. Accordingly, before the front part 4*f* is contacted to the ground while skating, the roller 20 is first contacted to the ground so as to enable the user to skate. In addition, before the rear part 4*r* is contacted to the ground while walking, the friction member 10 is first contacted to the ground so as to enable the user to walk safely.

Further, when the user wishes to improve skating function even though walking function is somewhat weakened, the roller 20 may be projected downwardly more than the friction member 10 so that the roller could be well contacted to the ground, and the outsole may be formed in an arch type so that only at front and rear parts are contacted to the ground.

Figure 5:
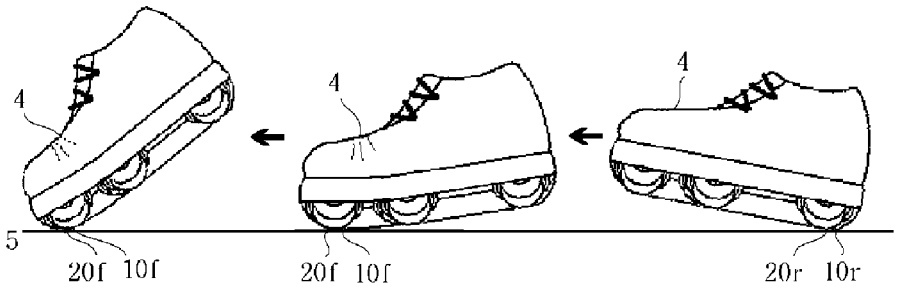
FIG. 5 is a side view illustrating walking motions subsequently.

On the other hand, referring to FIGS. 4B and 5, there are illustrated shoes that include two rollers at front and rear positions of a front part of a foot. A portion between the two rollers can be bent so that the user can naturally walk. Here, the roller may be arranged more nearly toward the front of the shoe in consideration of that the user's weight is more heavily loaded to the roller 20*f* at the front of the shoe while skating. In this time, the two rollers 20*f*1 and 20*f*2 share the user's weight.

Figure 6:
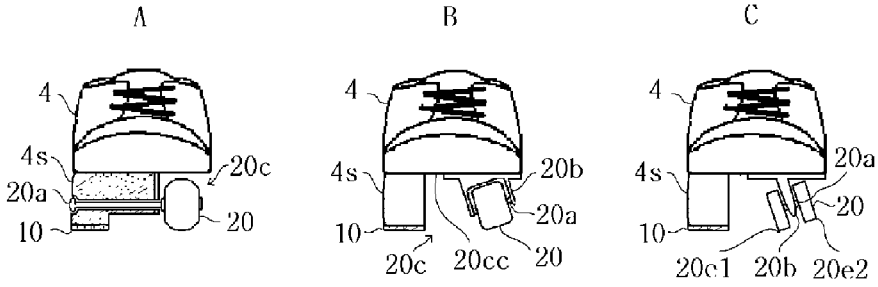
FIGS. 6A to 6C are front views illustrating various embodiments, where

Referring to FIG. 6, it is shown that shoes according to other embodiments include a roller 20 at a lower part and a roller receiving unit 20*c*. FIG. 6A shows a shoe including a rotating axis 20*a* of the roller directly born by an outsole 4*s*, that is, by a side wall of the roller receiving unit 20*c*. FIG. 6B shows a shoe including an outsole formed only on an outer edge 4*o* of a lower part of the shoe and a roller receiving unit formed on the remaining space of the lower part instead of the outsole, where a bracket 20*b* for bearing the rotating axis 20*a* of the roller is fixed to a ceiling 20*cc* (a midsole or a bottom of an upper structure of the shoe) of the roller receiving unit 20*c*. In this time, it is stronger to fix the bracket simultaneously to the outer edge of the outsole. FIG. 6C shows a shoe including a pair of parallel type rollers between the bracket and the rotating axis 20*a* instead of the drum type roller.

Figure 7:
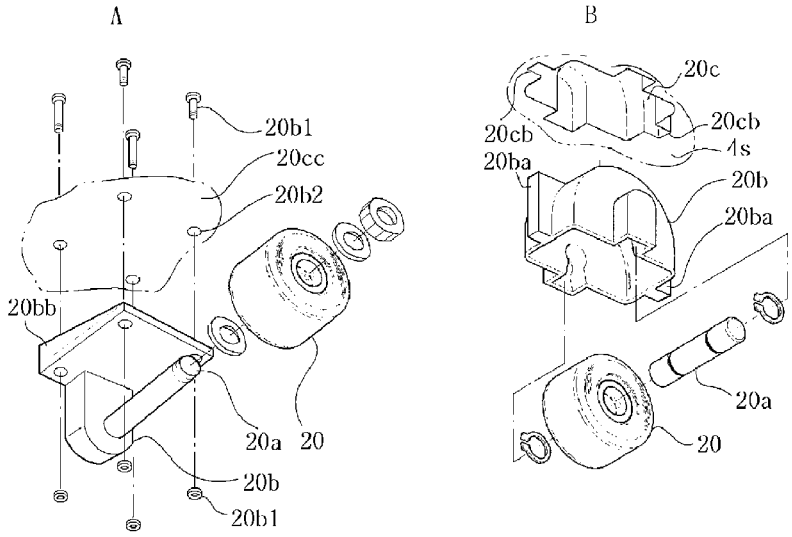
FIGS. 7A and 7B are exploded perspective views illustrating units for receiving, including and mounting the roller respectively, where

Referring to FIGS. 7A and 7B, the roller 20 is supported by the bracket 20*b* via the rotating axis 20*a* and the bracket 20*b* is received in the roller receiving unit 20*c* of the lower part. Referring to FIG. 7A, the roller is fixed to a ceiling 20*cc* of the roller receiving unit by a fixing element 20*b*1 like a screw and a through-hole 20*b*2. In this time, if an upper part of the bracket 20*b* is formed so as to have a slant part 20*bb*, the roller can be mounted on the slant regardless of a slant of the ceiling itself of the roller receiving unit.

Referring to FIG. 7B, the bracket 20*b* is tightly inserted into the roller receiving unit 20*c* formed at the outsole 4*s*. Here, referring to FIGS. 1 and 2, because the structure is unsuitable for supporting the bracket 20*b* in horizontal direction, the bracket 20*b* includes a separation preventing unit 20*ba* for horizontal direction and a separation preventing groove 20*cb* is formed in the roller receiving unit so as to fix the separation preventing unit tightly.

Figure 8:
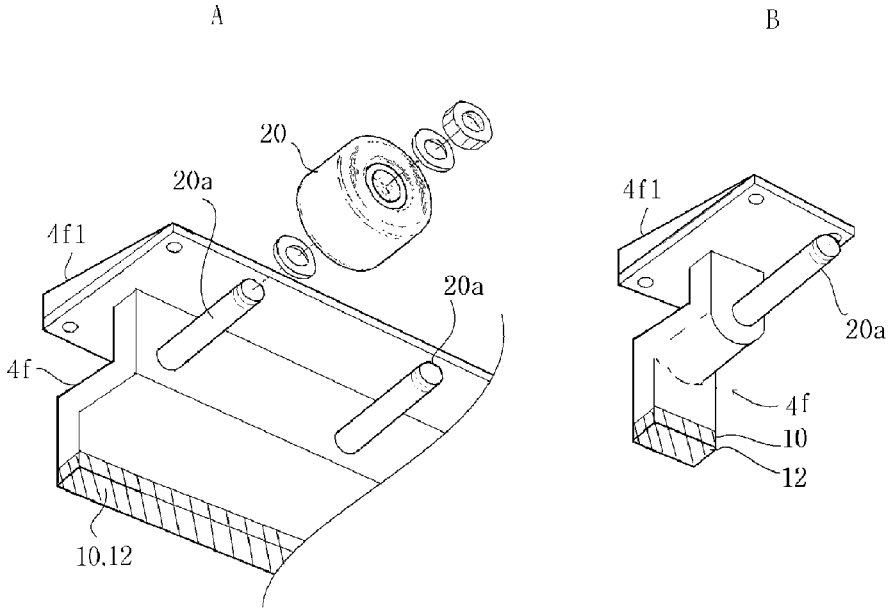
FIG. 8A is an exploded perspective view illustrating a bottom surface of the shoe which includes an extended part 4*f* extended from a lower part of the shoe, a friction member and a plurality of rollers at front and rear parts.
FIG. 8B is a perspective view illustrating the bottom surface of the extended part including one roller.
Figure 9:
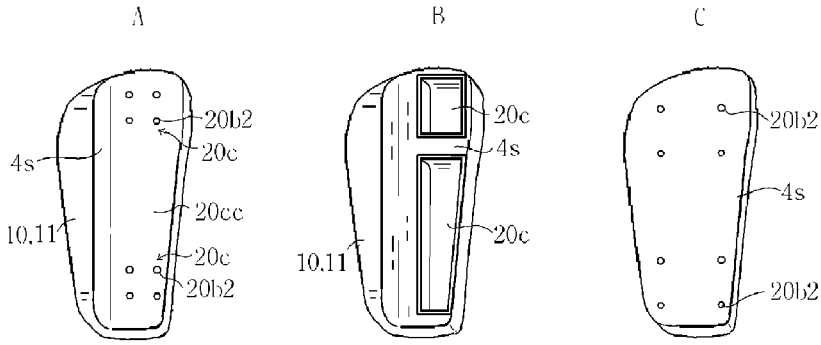
FIGS. 9A to 9C are bottom views illustrating the lower part of the shoe to be mounted with the bracket of FIG. 8, where
Figure 11:
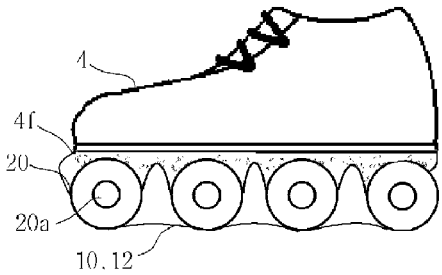
FIG. 11 is a side view illustrating the shoe formed in a shape of a general inline skate by using the extended part.
Figure 12:
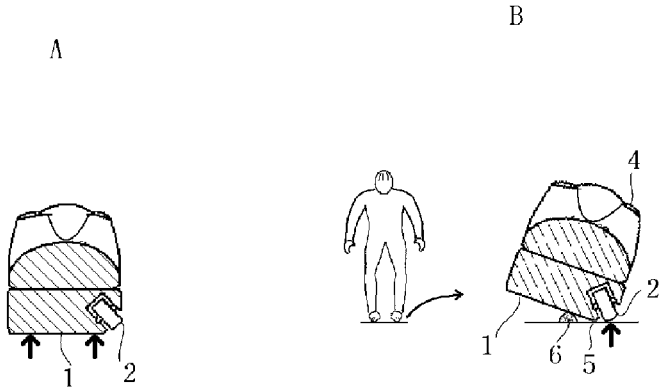
FIGS. 12A and 12B are front views illustrating operations of a conventional skating shoe, where

Referring to FIGS. 8A and 8B, a shoe includes a separate extended part 4*f* such as a wheel frame of an inline skate at a lower part of the shoe, in this case, at a bottom part of an outsole 4*s* so as to support a friction member 10 and a roller 20. Accordingly, the shoe can include a roller 20 of large diameter like the inline skate so that it can provide the shape and function similar to a professional inline skate as shown in FIG. 11. Further, referring to FIG. 8B, an upper plate 4*f*1 of the extended part may be slanted so as to provide the roller with an inward slope. The upper plate 4*f*1 of the extended part may be fixed to the lower part or the bottom part of the outsole by fixing element 20*b*1, or may be detachable by a detaching unit so that the user can easily alternate the shoes to normal shoes when the user do not want to use for a long time.

FIG. 8A shows a bottom part of the shoe which can mount a plurality of rollers on front and rear parts of one extended part 4*f*, and FIG. 8B shows a bottom part of the shoe which includes one roller per each extended part.

Accordingly, at least one extended part 4*f* is extended downwardly from the outsole of the shoe and the friction member is included in the bottom part of the extended part so as to be arranged at a predetermined position of the outer edge of the lower part.

Figure 10:
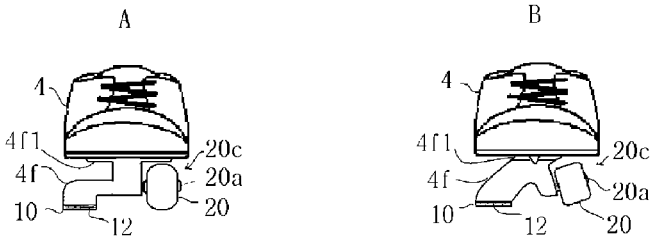
FIGS. 10A and 10B are front views illustrating the shoe including the extended part, where

The plurality of rollers 20 are supported by a side part of the extended part via the rotating axis 20*a* so as to be arranged at a predetermined position. As shown in FIG. 10A or 10B, the rollers may be directly supported by the extended part 4*f*, or may be supported by a bracket fixed to the extended part. Here, according to the user's need, the extended part of the friction member and the extended part of the roller can be provided separately.

As shown in FIG. 10B, the extended part 4*f* may be fixed on the slant or the inside of the extended part may be slanted so that the bottom part of the roller 20 is protruded toward the user so as to form a reverse camber.

According to the present invention, there are provided skating shoes that are possible of direct alternation between walking and skating without a particular mechanical or functional converting unit classified in the international patent classification, IPC A63C 17/20. The user can easily and immediately adapt to frequent changes of environment of walking and skating. Simultaneously, the user can perform self-driving skating by pushing the ground directly with the roller without depending on gravity of downhill or inertia of walking and thus, the user can play inline skating without an additional inline skate. Accordingly, the skating shoes can be used for sports as well as a transport means for short distance.

The invention claimed is:

1. Skating shoes, comprising:

a left shoe and a right shoe configured to be worn by a user, a lower part of each shoe including:

a friction member protruding downwardly in a longitudinal direction at an outer edge of the lower part so as to produce friction with the ground, a plurality of rollers protruding downwardly in a longitudinal direction at an inner edge of the lower part and configured to provide rolling movement with respect to the ground, and a space portion formed upwardly between the friction member and the roller, wherein the friction member and the roller, excluding the space portion, are configured to contact the ground in a walking mode, and wherein the shoe is slanted inwardly in a skating mode so that one shoe proceeds in a constant course and the other shoe proceeds in a direction transverse to the course while only the roller is in continuously contact with the ground so as to provide driving force.

2. The skating shoes of claim 1, further comprising an outsole, which includes an outer bottom part projected downwardly from its outer edge and a roller receiving unit formed upwardly at its inner edge; the friction member is the outer bottom part; and the roller is rollably received in the roller receiving unit so as to be protruded downwardly as far as the outer bottom part of the outsole.

3. The skating shoes of claim 2, wherein the roller receiving unit is slanted so that a bottom part of the roller is protruded toward the user so as to form a reverse camber.

4. The skating shoes of claim 3, wherein the roller receiving unit receives and fixes a bracket; and the bracket bears the roller.

5. The skating shoes of claim 4, wherein the bracket includes a separation preventing unit; the outsole includes a separation preventing groove for receiving the separation preventing unit; the bracket for bearing the roller is fixed to the roller receiving unit; and the separation preventing unit is tightly inserted into the separation preventing groove so as to be fixed.

6. The skating shoes of claim 2, wherein the roller is born by a side wall of the roller receiving unit.

7. The skating shoes of claim 1, further comprising at least one extended part extended downwardly from the lower part; the friction member is formed at a ground part of the extended part so as to be arranged at the outer edge of the lower part; and the roller is rollably formed at the extended part so as to be arranged at the inner edge of the lower part.

8. The skating shoes of claim 7, wherein the extended part is slanted or the roller is mounted on a slant portion of the extended part so that a bottom part of the roller is protruded toward the user so as to form a reverse camber.

9. The skating shoes of claim 7, wherein the bracket is fixed to the extended part and the roller is born by the bracket.

10. The skating shoes of claim 7, wherein the roller is born by a side part of the extended part.

11. The skating shoes of claim 1, wherein a bottom part of the roller is protruded toward the user so as to form a reverse camber; only a corner of the bottom part opposite to the protruded part is contacted to the ground while walking; and the shoe is slanted inwardly while the corner is continuously contacted to the ground so that a corner of the protruded part is also contacted to the ground while skating.

12. The skating shoes of claim 11, wherein width of the roller is gradually decreased in its longitudinal direction.

13. The skating shoes of claim 11, wherein the roller is born by the bracket and an upper part of the bracket is slanted so as to be fixed to a ceiling of the roller receiving unit or a ceiling of the lower part of the shoe.

14. The skating shoes of claim 11, wherein the friction member is protruded more outwardly than the outer edge of the lower part, and the roller is arranged near a central part of the lower part.

15. The skating shoes of claim 11, wherein two rollers are sequentially mounted on the front part of the shoe.

16. The skating shoes of claim 11, wherein the rearmost one of the rollers is arranged more forward than the friction member corresponding to it.

17. The skating shoes of claim 11, wherein the roller is protruded more downward than the friction member.

* * * * *